US005277146A

United States Patent [19]

Hughes, Jr.

[11] Patent Number: 5,277,146

[45] Date of Patent: Jan. 11, 1994

[54] LATERALLY SUPPORTED FLEXIBLE SIGN

[75] Inventor: Robert K. Hughes, Jr., Cape Coral, Fla.

[73] Assignee: Flexstake, Inc., Fort Myers, Fla.

[21] Appl. No.: 985,898

[22] Filed: Dec. 4, 1992

[51] Int. Cl.[5] ..... E01F 9/01; G09F 17/00

[52] U.S. Cl. ..... 116/63 R; 116/175; 40/608; 248/145; 248/417

[58] Field of Search ..... 116/63R, 173, 175, 209; 40/607, 608, 40/612; 248/417, 145, 289.3

[56] References Cited

U.S. PATENT DOCUMENTS

| | | | |
|---|---|---|---|
| 633,450 | 9/1899 | Handlan, Jr. | 116/175 |
| 851,012 | 4/1907 | Lanius | 116/175 |
| 884,950 | 4/1908 | Page | 116/175 |
| 2,550,338 | 4/1951 | Dunagan | 248/145 |
| 3,085,546 | 4/1963 | Pelletier | 40/607 X |
| 3,552,702 | 1/1971 | Springer | 40/607 X |
| 4,205,472 | 6/1980 | Shirley | 40/608 |
| 4,616,799 | 10/1986 | Rebentisch | 248/145 X |
| 4,805,331 | 2/1989 | Boggess et al. | 40/608 X |
| 4,852,847 | 8/1989 | Pagel | 248/145 X |
| 4,862,823 | 9/1989 | Hughes | 116/209 |
| 4,880,195 | 11/1989 | Lepley | 40/607 X |
| 4,893,455 | 1/1990 | Hughes | 40/608 X |
| 5,040,478 | 8/1991 | Hughes | 116/209 |
| 5,205,236 | 4/1993 | Hughes | 116/63 R |

FOREIGN PATENT DOCUMENTS

| | | | |
|---|---|---|---|
| 1511994 | 5/1978 | United Kingdom | 40/607 |

*Primary Examiner*—William A. Cuchlinski, Jr.
*Assistant Examiner*—John L. Beres
*Attorney, Agent, or Firm*—James E. Bradley

[57] ABSTRACT

A flexible sign post for use along roadsides which allows a sign to be deflected when hit by a passing object. The sign post consists of a number of mounting brackets which are spaced apart and secured to a substantially rigid vertical sign post. Each mounting bracket has a mandrel over which an elastomeric sleeve is fitted.

A number of substantially rigid braces are connected to the mounting brackets by the elastomeric sleeves. The sign can then be attached to the ends of the braces in a vertical position.

13 Claims, 3 Drawing Sheets

LATERALLY SUPPORTED FLEXIBLE SIGN

BACKGROUND OF THE INVENTION

1. Field of the Invention

This invention relates to a sign mounted to a post by a flexible element so that when a vehicle or other moving object hits the sign, the sign is deflected, thereby minimizing damage to the sign and returning the sign to its original position.

2. Description of the Prior Art

Sign posts used along roadways usually consist of some type of rigid post with a metal sign bolted directly to the post. These signs are vulnerable to damage from passing vehicles when objects, such as side mirrors, strike the sign. Since the whole sign is rigidly constructed, there is no point at which the sign or sign post can bend or flex without being damaged.

Prior patents have shown yielding roadway signs attached to sign posts by some type of hinge. This allows the sign to pivot. A metal spring is then utilized to provide a restoring force to return the sign to its original position after it has been impacted. These signs can only rotate in directions perpendicular to the axis of the hinge. Hinges are also more prone to failure and may tend to freeze or lock up.

U.S. Pat. Nos. 4,862,823, 4,893,455 and 5,040,478 show a means for supporting a marker to a shaft in the ground using a elastomeric sleeve-type element. The elastomeric element allows the marker to be bend and then restores the marker to its original position. Whereas a hinge only allows rotation in one direction, the elastomeric element allows the marker to bend in various directions.

SUMMARY OF THE INVENTION

This invention consists of a rigid sign post which has mounting brackets attached to the post. A series of rigid braces are attached to the mounting bracket by a flexible elastomeric sleeve. A plate or sign is mounted to the braces. The elastomeric sleeve allows the sign and braces to move in relation to the sign post, which remains stationary, after the sign has been hit by a passing object. The sign sustains little, if any damage, and returns to its original position once the object has passed by.

DETAILED DESCRIPTION OF THE INVENTION

Figure 1:
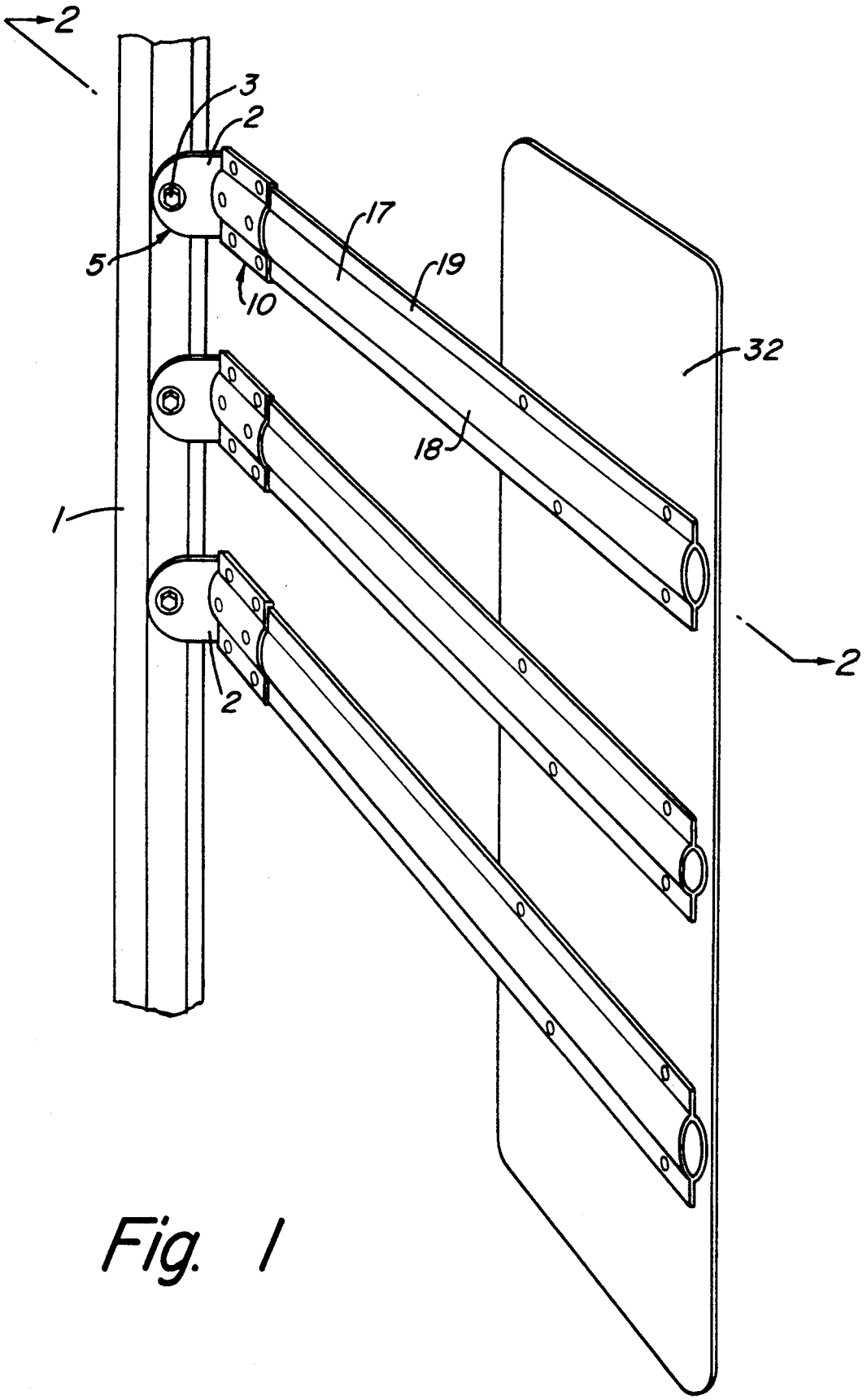
FIG. 1 is a perspective view illustrating a sign post constructed in accordance with this invention.

Referring to FIG. 1, the invention consists of a rigid sign post 1, which is usually mounted vertically. Post 1 may be of a variety of shapes and is conventional. A plurality of mounting brackets 5 are secured stationarily to post. Each mounting bracket 5 is attached to the sign post 1 by means of a bolt 3 which fits through a hole 4 shown in FIG. 3, in a flat connecting surface 2. Brackets 5 are spaced apart from each other along the length of the post 1.

Figure 3:
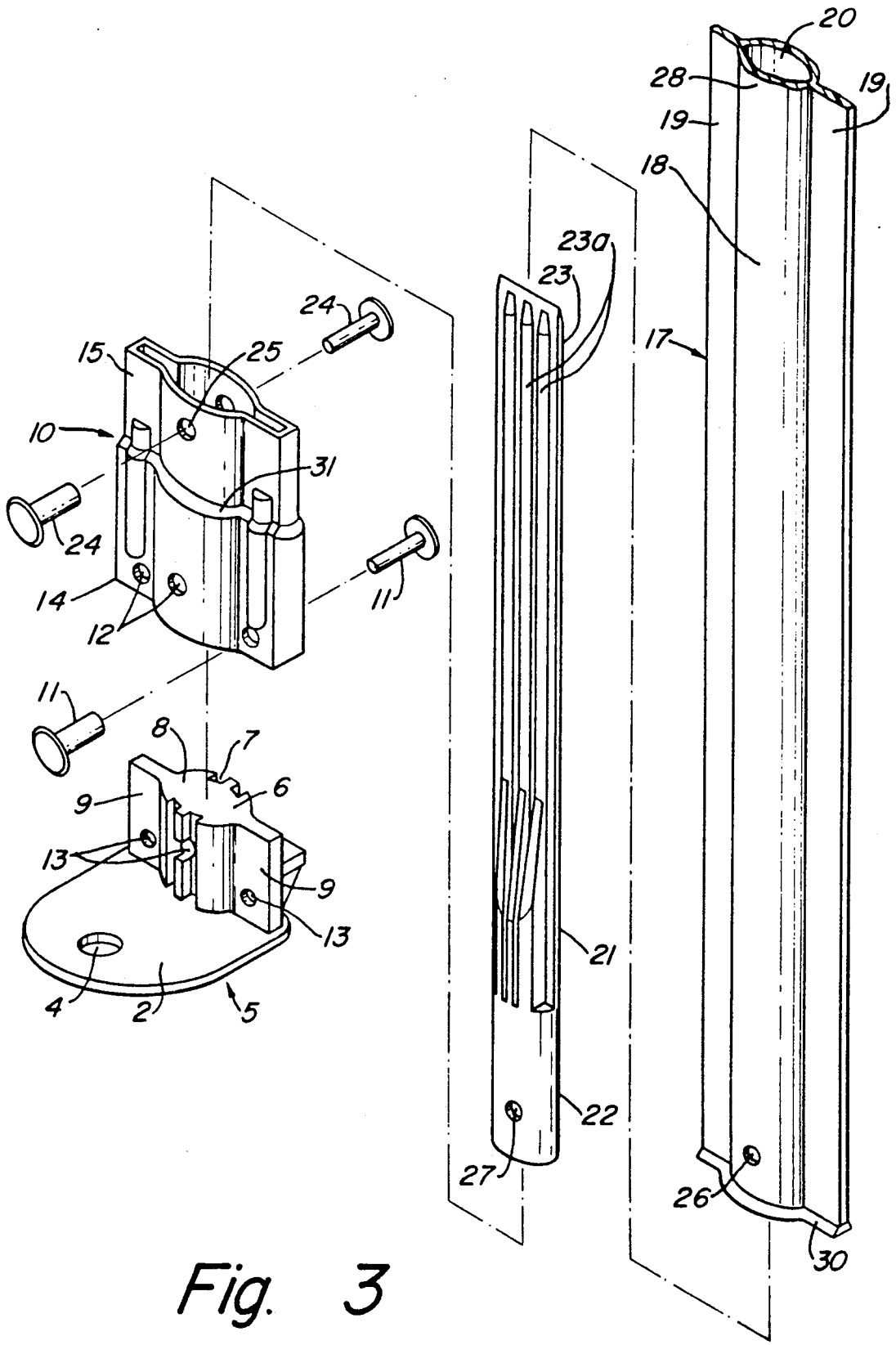
FIG. 3 is an exploded perspective view of the sign post of FIG. 1, illustrating the assembly of elements which are attached to the flexible sleeve.

Each mounting bracket 5, which can be more easily seen in FIG. 3, consists of a mandrel 6 which has a plurality of grooves 7. Mandrel 6 has a central portion 8 and two side portions 9. The connecting surface 2 and mandrel 6 on the mounting bracket 5 are perpendicular to each other. The central portion 8 is generally elliptical in cross-section. The side portions 9 are flat and located in a common plane. This results in a greater width of the mandrel 6 than its thickness. As used herein, the width means the distance from the side edge of one side portion 9 to the side edge of the other portion 9. The thickness is the distance across the central portion 8, measured perpendicular to the width. The mandrel 6 is solid and of a fairly rigid material.

An elastomeric sleeve 10, which has a mandrel end 14, fits over the mandrel 6 of the mounting bracket 5. Sleeve 10 is flexible and is generally flattened. The major dimension from one side to the other is greater than the minor dimension from front to back. When mounted vertically, the width from the lower side to the upper side exceeds the thickness measured from a forward side to a rearward side. The interior of the sleeve 10 is open so the mandrel end 14 closely receives and conforms to the configuration of the mandrel 6. The internal dimensions of the interior of the sleeve 10 are smaller in the brace end 15 than in the mandrel end 14. Three fasteners 11 extend through holes 12 in the sleeve 10 and holes 13 in the mandrel 6 to secure the sleeve 10 to the mandrel 6. Fasteners 11 are preferably rivets.

A substantially rigid brace 17 consists of a spine 18 with plate attachment surfaces 19. The plate attachment surfaces 19 are located in a common plane. The spine 18 has an oval bore 20 that extends throughout the length of the brace 17. The oval bore 20 has a major diameter which is measured along the plane that contains the plate attachment surfaces 19. It has a minor diameter that is perpendicular to the major diameter. This minor diameter, which would be considered the thickness, is of a lesser dimension than the major diameter.

A brace insert 21 is inserted into the lower portion of the oval bore 20. The brace insert 21 has a mounting end 22 and a free end 23. A plurality of ridges **23*a* are located on the exterior of the free end 23. The mounting end portion 22 of the brace insert 21 has an oval shape which corresponds to the shape of the oval bore 20. The brace insert 21 is inserted into the rigid brace 17 by inserting the free end 23 of the brace insert 21 into the lower portion of the brace 17. The brace insert 21 fits into the oval bore 20 of the brace 17 until the mounting end 22 of the brace insert 21 is substantially flush with the bottom of the rigid brace 17. The hole 27 in the brace insert 21 corresponds to the hole 26 in the brace 17. Brace 17 and insert 21 insert into, and secure to sleeve 10. Brace 17 and insert 21 are of a plastic material. The brace insert 21 provides added support to brace 17 to insure that the sleeve 10 bends, instead of the brace 17**, when impacted.

In assembly, the free end of the brace 28 is inserted into the elastomeric sleeve 10 with the brace insert 21 contained inside the oval bore 20 of the brace 17. The brace 17 is inserted inside the elastomeric sleeve 10 by inserting the free end 28 of the brace 17 into the mandrel end 14 of the of the sleeve 10. The free end 28 of brace 17 will pass through sleeve 10 during insertion and will be spaced therefrom after the assembly is complete. The brace 17 has a flange 30 which will abut the shoulder 31 of the sleeve 10. The brace 17 and brace insert 21 are held in place inside the sleeve 10 by a fastener 24 which is inserted through the hole 25 of the sleeve 10, and into the holes 26 and 27 of the brace 17 and brace insert 21.

Figure 2:
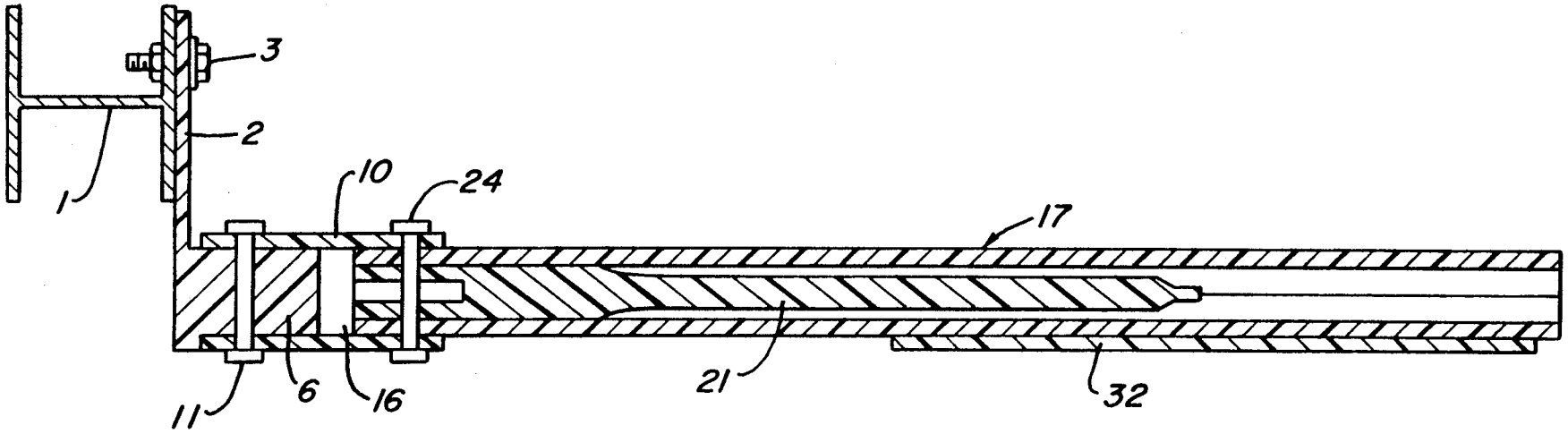
FIG. 2 is a sectional view of the sign post of FIG. 1 taken along a section line of the sign post of FIG. 1.

A clearance 16, which can be seen in FIG. 2, exists between the bottom of the brace 17 and brace insert 21, and the top of the mandrel 6. This clearance allows the sleeve 10 to flex more readily. Because the width of the sleeve 10 is greater than the thickness, the sleeve will tend to flex in directions which are perpendicular to the width of the sleeve 10.

The braces 17 extend parallel to each other and perpendicular to the post 1. A plate 32 or sign is attached to the attachment surfaces 19 of the braces 17 by screws. Plate 32 is flat and will locate in a vertical plane once attached. Plate 32 locates at and connects to the free ends 28 of the braces 17.

As the plate 32 or sign is impacted, the plate 32 will move from an initial position, bending at the elastomeric sleeve 10, to a second position until the force impacting the plate is removed. In the initial position, the axis of each brace 17 is coaxial with the axis of the mandrel 6 to which it is secured. When impacted, sleeve 10 will bend, allowing the braces 17 to pivot so that the axis of each intersects the axis of its mandrel 6 at an acute angle. Subsequently, the resilience of sleeves 10 causes the braces 17 to spring back into coaxial alignment with their mandrels 6. This prevents the sign post from being damaged by the force of the impact, since the force is deflected as the sign rotates.

This invention has significant advantages. The flexible sleeves reduce damage to signs and can flex in directions where a hinged sign would not. The flexible sleeve will also not freeze or lock up as a hinge might. The construction is simple and rugged and does not require a second spring component. The sign could also be used along waterways, around loading docks, along conveyor belts, or anywhere there is traffic or moving objects where it would be likely that objects would come into contact with the sign.

While the invention has been shown in only one of its forms, it should be apparent to those skilled in the art that it is not so limited, but is susceptible to various changes without departing from the scope of the invention.

What is claimed is:

1. A flexible sign post apparatus comprising in combination:

a substantially rigid post;

at least one mounting bracket stationarily mounted to the post;

at least one substantially rigid brace; and at least one elastomeric sleeve connecting the mounting bracket to the brace, with the brace extending substantially perpendicular to the post, allowing the brace to pivot from a first position to a second position at the elastomeric sleeve when the brace is impacted.

2. The apparatus according to claim 1, wherein:

the mounting bracket has a mandrel over which the elastomeric sleeve is fitted and has a connecting surface extending from the mandrel for securing the mounting bracket to the post.

3. The apparatus according to claim 1, wherein:

there are a plurality of the braces, the braces being parallel with each other, being spaced at intervals along the length of the post, each of the braces being mounted to one of the mounting brackets by one of the elastomeric sleeves.

4. The apparatus according to claim 1, wherein:

the elastomeric sleeve has a width exceeding its thickness, the width being measured from a lower side to an upper side, the thickness being measured from a forward side to a rearward side.

5. The apparatus according to claim 1, wherein:

the brace has a free end opposite a mounting end that mounts to the elastomeric sleeve;

the apparatus further comprising a plate secured to the free end of the brace.

6. The apparatus according to claim 1, wherein:

the post is positioned vertically.

7. A flexible sign post apparatus comprising in combination:

a substantially rigid vertical post;

a plurality of mounting brackets stationarily spaced apart and secured along the length of the post, each of the brackets having a mandrel;

a plurality of substantially rigid braces, each of the braces having a mounting end and a free end;

a plurality of elastomeric sleeves, each connected between one of the mandrels and one of the mounting ends, so as to extend the braces laterally from the post; and a plate secured to and connecting each of the free ends together, the plate being located in a vertical plane.

8. The apparatus according to claim 7, wherein:

each of the mounting brackets has a connecting surface which is perpendicular to the mandrel for securing the mounting bracket to the post.

9. The apparatus according to claim 7, wherein:

each of the elastomeric sleeves has a width exceeding its thickness, the width being measured from a lower side to an upper side, the thickness being measured from a forward side to a rearward side.

10. The apparatus according to claim 7, wherein:

the elastomeric sleeve urges the brace to a first position from a second position at the sleeve after the brace has been impacted.

11. A flexible sign post apparatus comprising in combination:

a substantially rigid vertical post;

a plurality of mounting brackets, each of the brackets having a mandrel with a central longitudinal axis, the mounting brackets having a connecting surface which is perpendicular to the mandrel;

means for securing the mounting brackets to the post spaced apart along the length of the post, with the connecting surface flush against the post, and the mandrel protruding laterally from the post;

a plurality of substantially rigid braces, each of the braces having a mounting end and a free end, and having a spine with an internal oval bore which extends throughout the length of the brace from the mounting end to the free end, the internal bore having constant dimensions and having an inside surface throughout the length of the brace, and having plate attachment surfaces disposed along a central longitudinal axis of the brace which are integrally formed with the spine;

a plurality of substantially rigid brace inserts, each of which is inserted into the internal bore of the brace;

a plurality of elastomeric sleeves, each having a mandrel end which is inserted over the mandrel of the mounting bracket, each of the sleeves having a width exceeding its thickness, the width being measured from a lower side to an upper side, the thickness being measured from a forward side to a rearward side, the elastomeric sleeves positioning the braces perpendicular to the post and urging the braces and brace inserts to a first position wherein each brace is substantially coaxial with the mandrel to which it is secured, and allowing each brace and brace insert to bend at the sleeve in directions perpendicular to the width of the elastomeric sleeve to a deflected second position; and a plate secured to and connecting the plate attachment surfaces of the free ends of the braces, wherein the plate is in a vertical plane.

12. The apparatus according to claim 11, wherein:

the insert has a mounting end and a free end, the mounting end having an oval cross section which corresponds to the internal oval bore of the brace and fitting fully against the inside surface of the internal oval bore extending laterally along a portion of the internal oval bore, and tapering towards the free end of the insert, forming a substantially rectangular cross section for providing support to the laterally extending brace.

13. The apparatus according to claim 11, wherein:

the elastomeric sleeve has a clearance located between the mandrel of the mounting bracket and the mounting end of the brace and brace insert.

* * * * *